US008399755B2

(12) United States Patent
Wang

(10) Patent No.: US 8,399,755 B2
(45) Date of Patent: Mar. 19, 2013

(54) CONNECTION ASSEMBLY FOR DRUM SHELL

(76) Inventor: Wei-Pin Wang, Taichung County (TW)

( * ) Notice: Subject to any disclaimer, the term of this patent is extended or adjusted under 35 U.S.C. 154(b) by 184 days.

(21) Appl. No.: 12/917,108

(22) Filed: Nov. 1, 2010

(65) Prior Publication Data

US 2012/0103164 A1 May 3, 2012

(51) Int. Cl.
*G10D 13/02* (2006.01)
*G10D 3/12* (2006.01)

(52) U.S. Cl. ..... 84/421

(58) Field of Classification Search ..... 84/421
See application file for complete search history.

(56) References Cited

U.S. PATENT DOCUMENTS 7,381,876 B2 * 6/2008 Miyajima ..... 84/421
7,906,718 B1 * 3/2011 Liao ..... 84/411 R
7,943,840 B2 * 5/2011 Yoshino et al. ..... 84/421
RE42,487 E * 6/2011 May ..... 84/421
2010/0180749 A1 7/2010 Yang
2010/0313734 A1 * 12/2010 Yoshino et al. ..... 84/421
2011/0030531 A1 * 2/2011 Nakata et al. ..... 84/421

* cited by examiner

*Primary Examiner* — Jeffrey Donels
(74) *Attorney, Agent, or Firm* — Muncy, Geissler, Olds & Lowe, PLLC

(57) ABSTRACT

A connection assembly of the present invention is provided for connecting a drum shell to a support. The connection assembly includes at least two fixation pieces, a connection member, two positioning bolt and a clamp. The fixation pieces are fixed on the drum shell. The fixation pieces are fastened on the connection member along a horizontal direction and a horizontal direction by the positioning bolts and several tension rods. The clamp is disposed on the connection member. The clamp is used for being detachably connected to the support.

As such, the drum assembled from the drum shell is stably supported by the connection assembly. Performance can be precisely provided.

4 Claims, 3 Drawing Sheets

CONNECTION ASSEMBLY FOR DRUM SHELL

BACKGROUND OF THE INVENTION

1. Field of the Invention

The present invention relates to a connection assembly which is used for connecting a drum shell to a support.

2. Description of the Prior Art

In a drum set, drums are gathered for a single drummer to play. For fixation purpose, connection assemblies or similar devices are used for connecting the drums to a support, such as tripod or bass drum.

In patent application US 2010/0180749, a connection device is disclosed. The connection device has two connecting ends 16 connected to adjusting rods 81 of a drum. As such, the drum can be fixed by the connection device.

However, the drum is held by the connection device in a particular direction. In practical operation, the drum is still swayable. If drums are not firmly positioned, drummers can not control the drums well, and quality of the performance can be hardly improved.

The present invention is, therefore, arisen to obviate or at least mitigate the above mentioned disadvantages.

SUMMARY OF THE INVENTION

The main object of the present invention is to provide another connection assembly which is able to connect a drum to a support stably.

To achieve the above and other objects, a connection assembly of the present invention is used for connecting a drum shell to a support. The connection assembly includes at least two fixation pieces, a connection member, two positioning bolts and a clamp.

The fixation pieces are adapted for being disposed on periphery of the drum shell respectively. Each fixation piece has a vertical threaded hole and a horizontal fixation hole. The vertical threaded hole is adapted for a tension rod to be screwed therein.

The connection member includes a connecting portion, two connecting arms and two fixing portions. The connecting arms stretch from two sides of the connecting portion toward one of the fixation pieces respectively. Each connecting arm has a distal end. The fixing portions are disposed on one of the distal ends respectively. Each fixing portion includes a horizontal positioning section and a vertical positioning section. The horizontal positioning section defines a first hole corresponding to the vertical threaded hole. The vertical positioning section defines a second hole corresponding to the horizontal fixation hole. The first hole is adapted for the tension rod to insert therethrough.

Each positioning bolt inserts in one of the second holes and the corresponding horizontal fixation hole.

The clamp is disposed on the connecting portion. The clamp is adapted for being detachably connected to the support.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
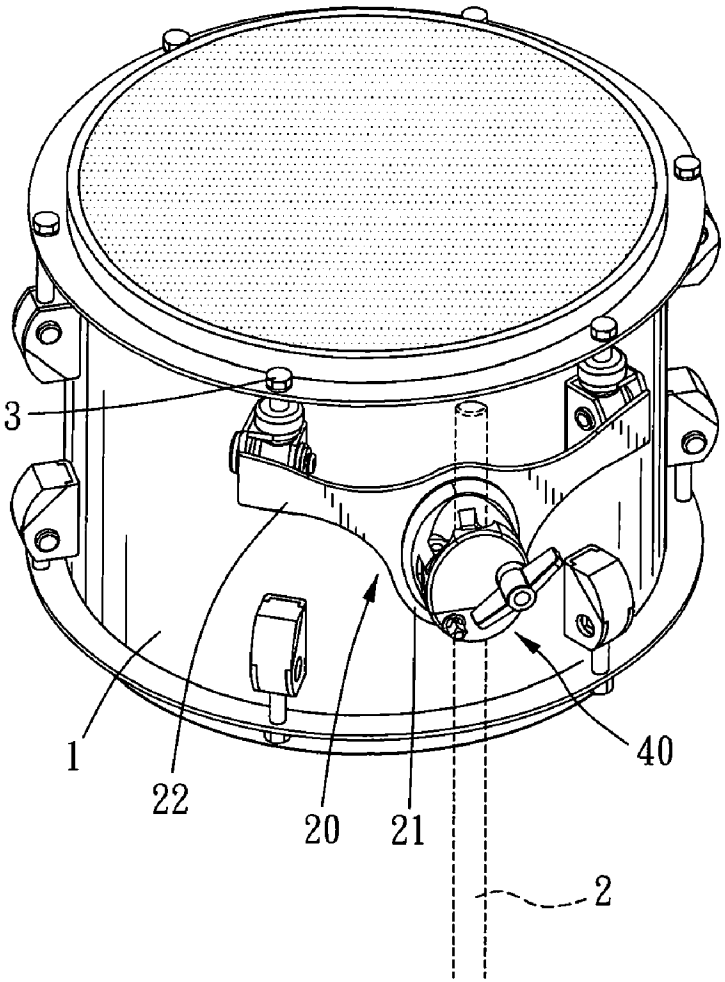
FIG. 1 is a combination drawing showing a preferred embodiment of the present invention.

Please refer to FIG. 1. The connection assembly of the present embodiment is used for connecting a drum shell to a support. The support may include a supporting pole 2 which is adapted for tripods or other drums to hold stably.

Figure 2:
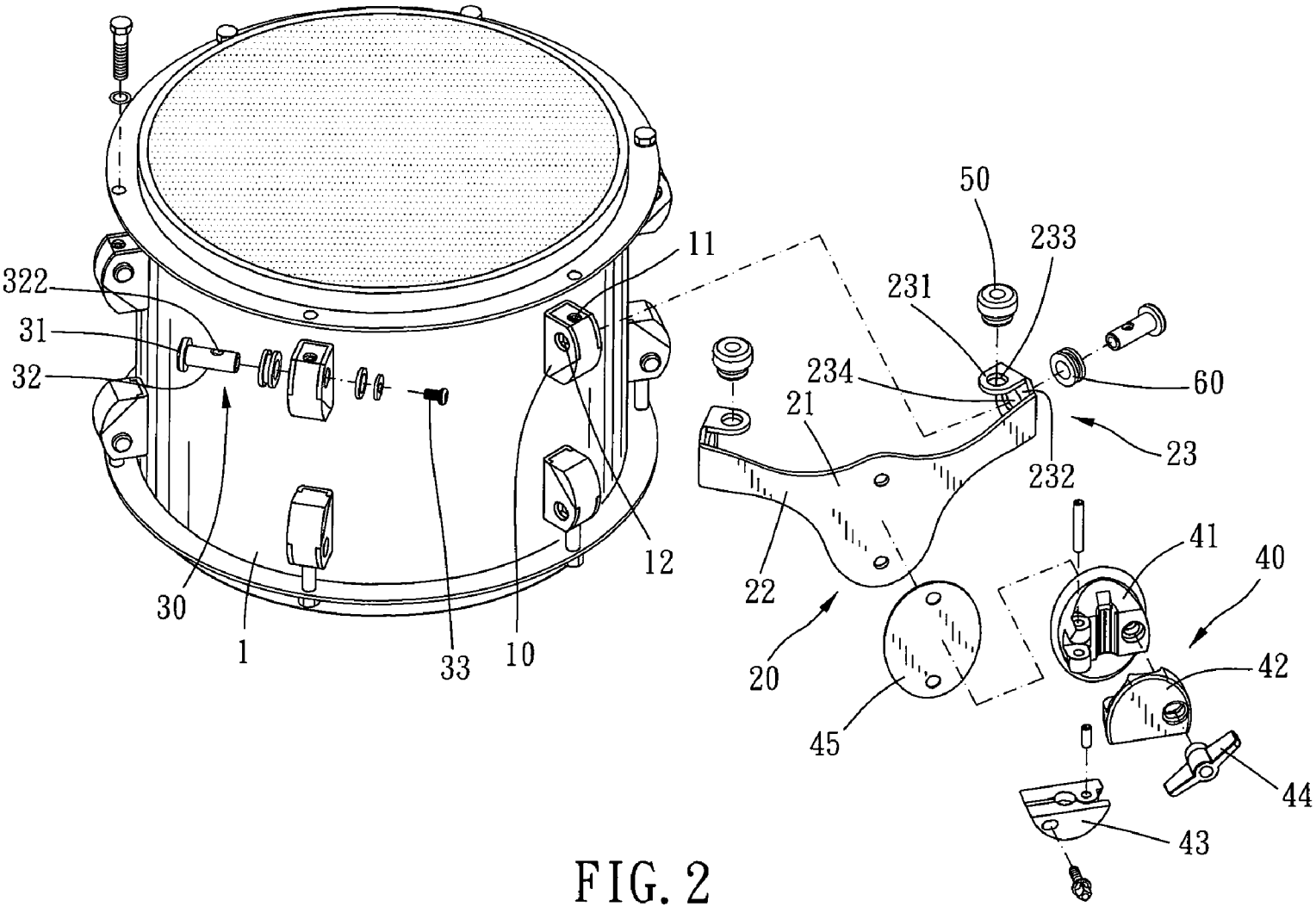
FIG. 2 is a breakdown drawing showing a preferred embodiment of the present invention.
Figure 4:
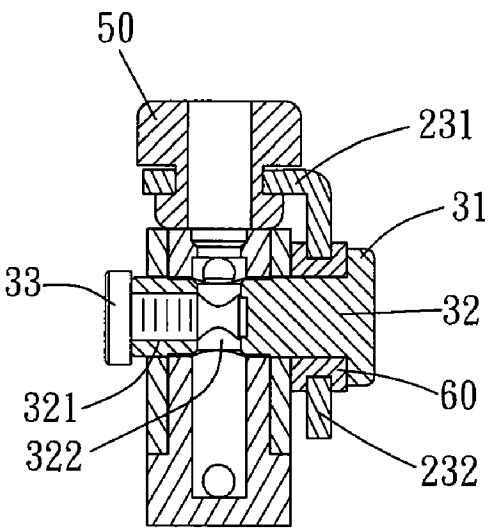
FIG. 4 is an AA profile of FIG. 3.
Figure 3:
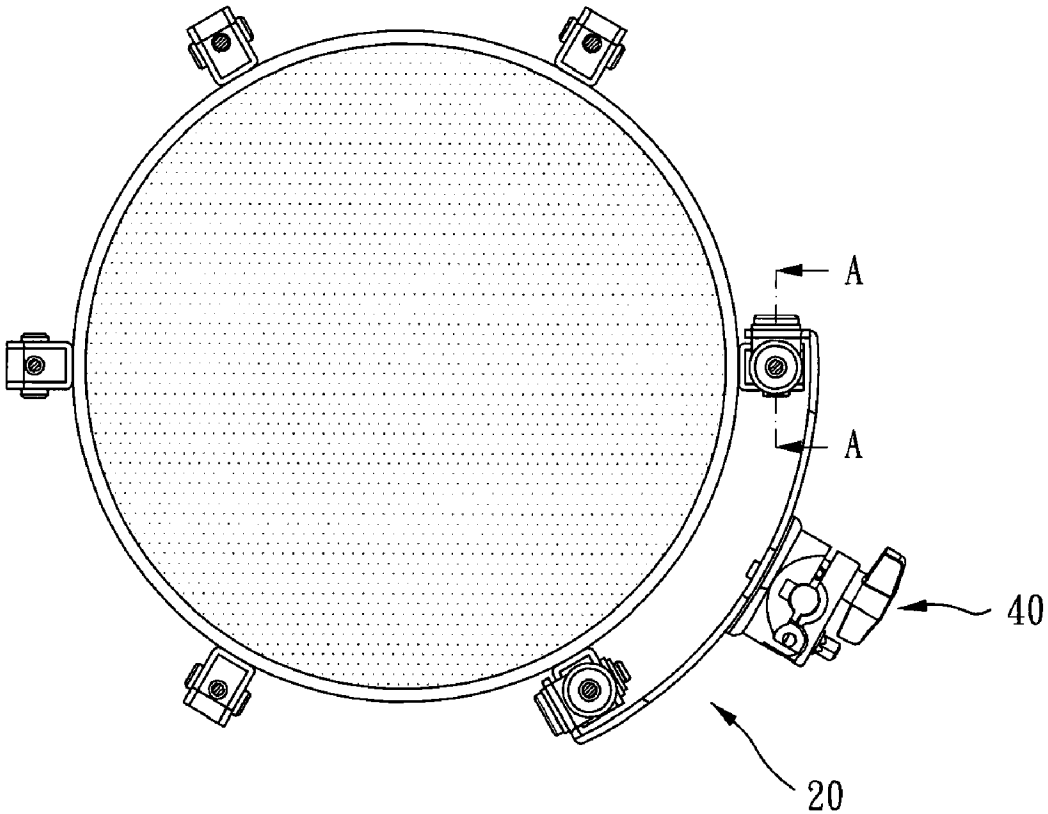
FIG. 3 is a top view showing a preferred embodiment of the present invention.

Please refer to FIG. 2 to FIG. 4. In a preferred embodiment, the connection assembly includes two or more than two fixation pieces 10, a connection member 20, two positioning bolts 30, a clamp 40, two first washers 50 and two second washers 60.

The fixation pieces 10 are disposed on periphery of the drum shell 1 respectively. Each fixation piece 10 has a vertical threaded hole 11 and a horizontal fixation hole 12. The vertical threaded hole 11 is adapted for a tension rod 3 to be screwed therein. The tension rod 3 can be adjusted for tightening or loosening a drumhead.

The connection member 20 includes a connecting portion 21, two connecting arms 22 and two fixing portions 23. The connecting arms 22 stretch from two sides of the connecting portion 21 toward one of the fixation pieces 10 respectively. Each connecting arm 22 has a distal end. The fixing portions 23 are disposed on the distal ends of the connecting arms 22 respectively. Each fixing portion 23 includes a horizontal positioning section 231 and a vertical positioning section 232. The horizontal positioning section 231 defines a first hole 233 corresponding to the vertical threaded hole 11. The vertical positioning section 232 defines a second hole 234 corresponding to the horizontal fixation hole 12. The first hole 233 is adapted for tension rod 3 to insert therethrough. Preferably, the vertical positioning section 232 stretches vertically from the distal end of the connecting arm 22. The horizontal positioning section 231 stretches laterally from the vertical positioning section 232. In other possible embodiments of the present invention, the horizontal positioning section and the vertical positioning section may stretch from the connecting arm respectively. Furthermore, the horizontal positioning section may connect the vertical positioning section to the connecting arm.

Each positioning bolt 30 inserts in one of the second holes 234 and the corresponding horizontal fixation hole 12. Preferably, each positioning bolt 30 includes a head portion 31, a tubular body 32 and a threaded member 33. A diameter of the head portion 31 is larger than that of the tubular body 32. The tubular body 32 has an axial hole 321 and a lateral through hole 322. The axial hole 321 extends along an axial direction defined by the tubular body 32. The axial hole 321 has a threaded distal end. The tubular body 32 inserts in the horizontal fixation hole 12. The head portion 31 abuts against the fixation piece 10. The threaded member 33 is screwed in the threaded distal end of the tubular body 32. The lateral through hole 322 is aligned with the vertical threaded hole 11 of the fixation piece 10. The lateral through hole 322 is adapted for the tension rod 3 to insert therein.

The clamp 40 is disposed on the connecting portion 21. The clamp 40 is detachably connected to the supporting pole 2 of the support. More particularly, the clamp 40 may include an inner jaw 41, an outer jaw 42, a lower positioning piece 43, a locking member 44 and a pad 45. The inner jaw 41 is connected to the connecting portion 21. The pad 45 is positioned between the inner jaw 41 and the connecting portion 21. One side of the outer jaw 42 is pivotably disposed on the inner jaw 41. A groove is defined by the outer jaw 42 and the inner jaw 41. The groove is adapted for the supporting pole 2 to be received therein. The other side of the outer jaw 42 abuts against the locking member 44. The outer jaw 42 is pressed toward the inner jaw 41 by the locking member 44. As such, the outer jaw 42 and the inner jaw 41 are able to clamp the supporting pole 2 therebetween. The lower positioning piece 43 is disposed beneath the outer jaw 42. The lower positioning piece 43 has a through hole corresponding to the groove, so that the supporting pole 2 can insert into the through hole.

Each first washer 50 is positioned between one of the first holes 233 and the corresponding tension rod 3. Each second washer 60 is positioned between one of the second holes 234 and the corresponding positioning bolt 30. Preferably, the first washers and the second washers are made of flexible material.

Accordingly, the tension rod can do no influence on engagement relationship of the connection member and the fixation pieces when the tension rod is adjusted. Furthermore, the connection member is able to stably hold the fixation pieces in both vertical direction and horizontal direction. As such, drums can be stably supported by the connection assembly and the support. Drummers may achieve a precise performance with the drums.

What is claimed is:

1. A connection assembly for a drum shell, used for connecting the drum shell to a support, the connection assembly comprising:

at least two fixation pieces, adapted for being disposed on periphery of the drum shell respectively, each fixation piece having a vertical threaded hole and a horizontal fixation hole, the vertical threaded hole being adapted for a tension rod to be screwed therein;

a connection member, comprising a connecting portion, two connecting arms and two fixing portions, the connecting arms stretching from two sides of the connecting portion toward one of the fixation pieces respectively, each connecting arm having a distal end, the fixing portions being disposed on one of the distal ends respectively, each fixing portion comprising a horizontal positioning section and a vertical positioning section, the horizontal positioning section defining a first hole corresponding to the vertical threaded hole, the vertical positioning section defining a second hole corresponding to the horizontal fixation hole, the first hole being adapted for the tension rod to insert therethrough;

two positioning bolts, each positioning bolt inserting in one of the second holes and the corresponding horizontal fixation hole;

a clamp, disposed on the connecting portion, the clamp being adapted for being detachably connected to the support.

2. The connection assembly of claim 1, wherein the vertical positioning sections stretch from the distal ends vertically, the horizontal positioning sections stretch from the vertical positioning sections laterally.

3. The connection assembly of claim 1, further comprising:

two first washers, each first washer being positioned between one of the first holes and the corresponding tension rod;

two second washers, each second washer being positioned between one of the second holes and the corresponding positioning bolt.

4. The connection assembly of claim 1, wherein each positioning bolt comprises a head portion, a tubular body and a threaded member, a diameter of the head portion is larger than that of the tubular body, the tubular body has an axial hole and a lateral through hole, the axial hole extends along an axial direction defined by the tubular body, the axial hole has a threaded distal end, the tubular body inserts in the horizontal fixation hole, the head portion abuts against the fixation piece, the threaded member is screwed in the threaded distal end, the lateral through hole is aligned with the vertical threaded hole, the lateral through hole is adapted for the tension rod to insert therein.

* * * * *